United States Patent [19]

Marritt

[11] 3,956,955

[45] May 18, 1976

[54] LEDGERS FOR THE CUTTING DEVICES OF CIGARETTE AND LIKE ROD-MAKING MACHINES

[75] Inventor: Clifford Russell Marritt, London, England

[73] Assignee: Molins Limited, London, England

[22] Filed: Feb. 6, 1975

[21] Appl. No.: 547,416

[30] Foreign Application Priority Data

Feb. 8, 1974 United Kingdom..... 05815/74

[52] U.S. Cl...... 83/310; 83/328

[51] Int. Cl.[2]..... A24C 5/28

[58] Field of Search..... 83/310, 327, 328

[56] References Cited

UNITED STATES PATENTS

| | | | |
|---|---|---|---|
| 3,440,912 | 4/1969 | Verjux | 83/310 |
| 3,479,913 | 11/1969 | Goemann et al. | 83/327 X |

*Primary Examiner*—J. M. Meister

*Attorney, Agent, or Firm*—John C. Smith, Jr.

[57] ABSTRACT

A ledger for use in a continuous rod cigarette making machine, or a similar machine, comprising a rod support to support the continuous rod during cutting, characterised by a rotary member which is arranged to rotate about a fixed axis, a first planetary gear which carries or is connected to the rod support and is rotatable relative to the rotary member about an axis which is parallel to the fixed axis and is spaced from the fixed axis by an adjustable distance, the first planetary gear being maintained in a fixed orientation at least partly by the action of a second planetary gear which is mounted rotatably on the rotary member and meshes with a drive gear which is arranged to rotate about the fixed axis at a speed different from that of the rotary member.

9 Claims, 9 Drawing Figures

LEDGERS FOR THE CUTTING DEVICES OF CIGARETTE AND LIKE ROD-MAKING MACHINES

This invention is concerned with ledgers for use in continuous rod cigarette making machines or similar machines, for example cigarette filter making machines, to support the continuous rod during cutting. Ledgers for this purpose have commonly in the past consisted of a reciprocating member which reciprocated in order to move with the rod during cutting and while supporting the rod. The present invention is concerned with ledgers having a purely rotary motion.

According to this invention, a ledger for use in a continuous rod cigarette making machine, or a similar machine, comprises a rod support to support the continuous rod during cutting characterised by a rotary member which is arranged to rotate about a fixed axis, a first planetary gear which carries or is connected to the rod support and is rotatable relative to the rotary member about an axis which is parallel to the fixed axis and is spaced from the fixed axis by an adjustable distance, the first planetary gear being maintained in a fixed orientation at least partly by the action of a second planetary gear which is mounted rotatably on the rotary member and meshes with a drive gear which is arranged to rotate about the fixed axis at a speed different from that of the rotary member.

The drive gear preferably comprises an annular member which surrounds the second planetary gear and is formed with internal gear teeth. These internal gear teeth may mesh directly with the second planetary gear or via an intermediate planetary gear also carried by the rotary member.

Examples of ledgers according to this invention are shown in the accompanying drawings. In these drawings.

Figure 1:
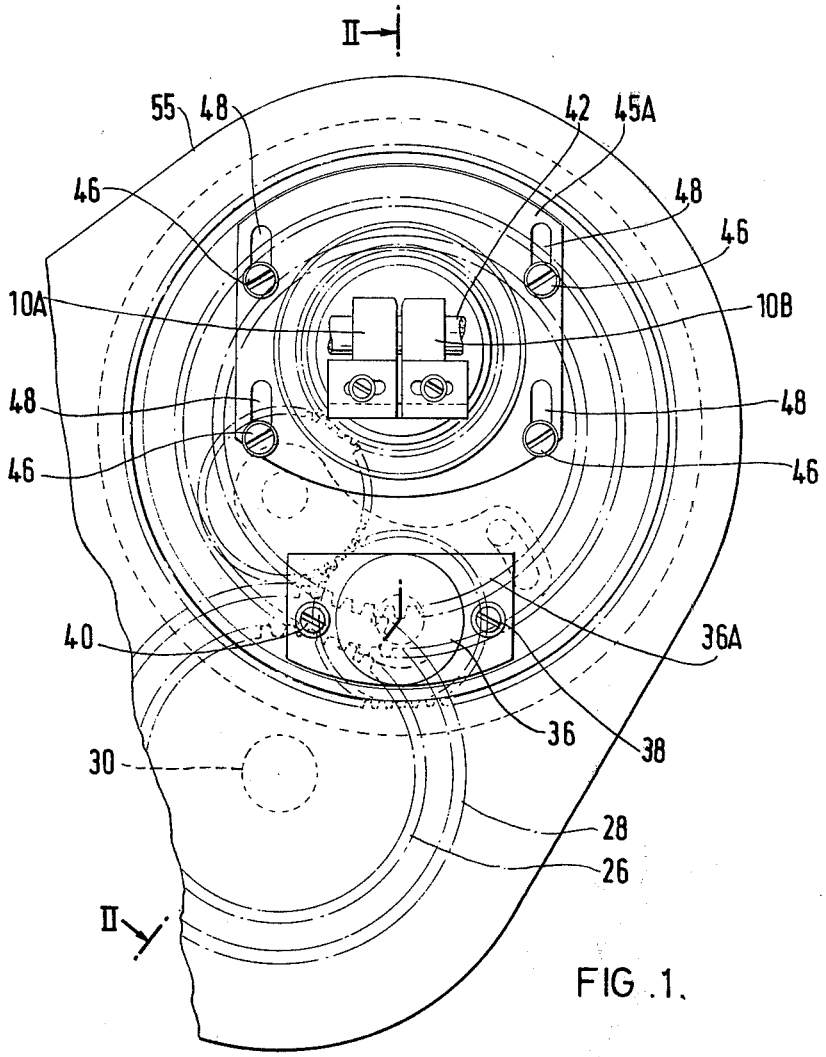
FIG. 1 is a fragmentary side view of the ledger.
Figure 2:
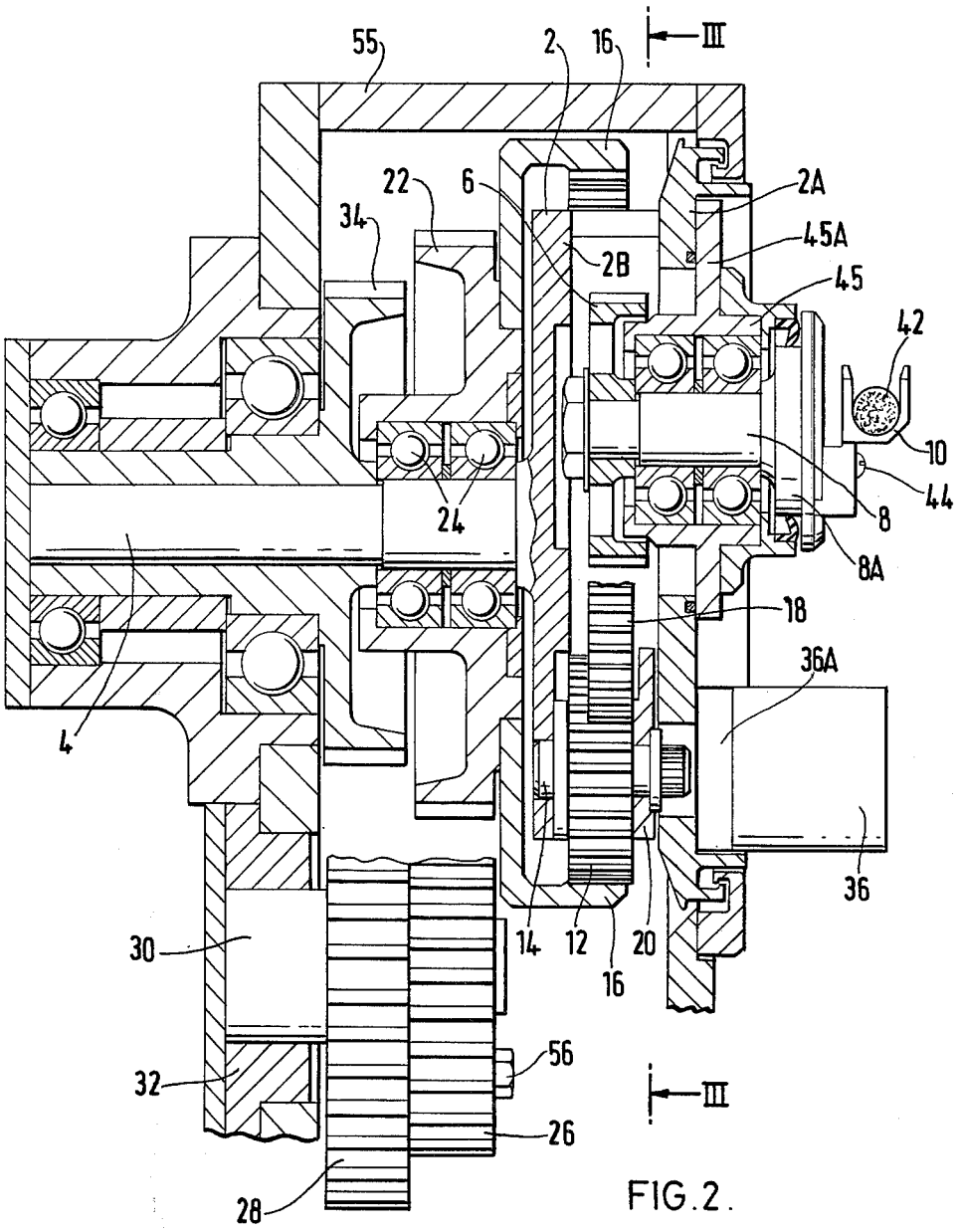
FIG. 2 is a section on the line II—II in FIG. 1.
Figure 3:
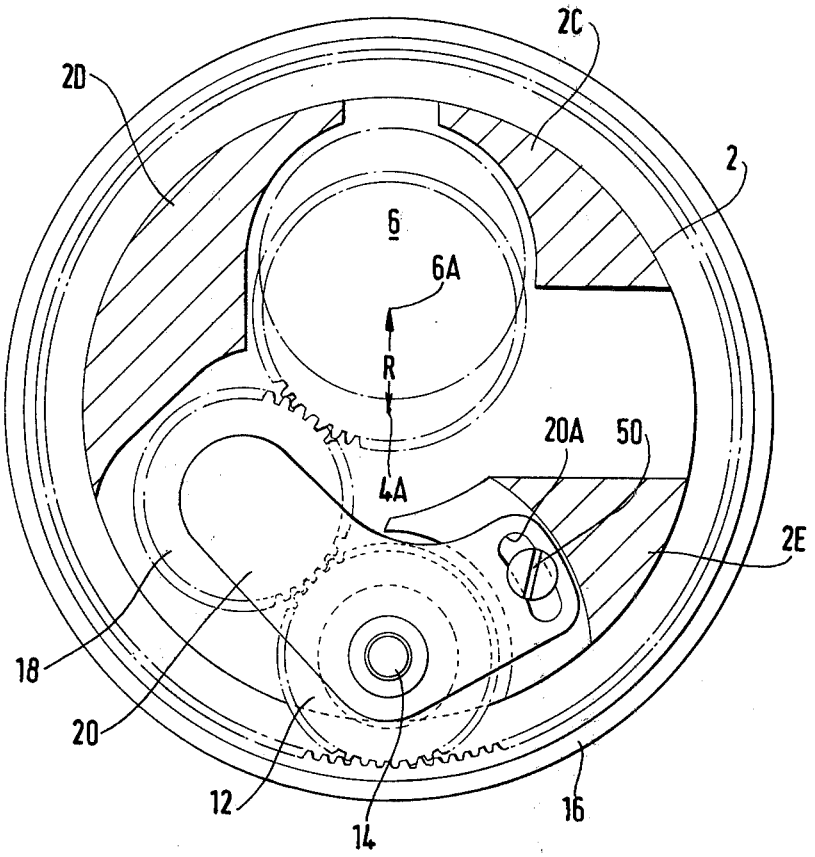
FIG. 3 is a section on the line III—III in FIG. 2, with parts removed for the sake of clarity.

The ledger shown in FIGS. 1 to 3 includes a rotary member 2 mounted on a central shaft 4 having an axis of rotation 4A (see FIG. 3). The rotary member 2 comprises an annular front part 2A and a disc-shaped rear part 2B, the two parts being spaced apart axially and being joined integrally by three shaped bridging parts 2C, 2D and 2E shown in section in FIG. 3.

Between the front and rear parts 2A and 2B of the rotary member there are three gears which form the basic mechanism of the ledger, Firstly there is a first planetary gear 6 which is mounted on a shaft 8 which carries a rod-supporting U-sectioned part 10; the shaft 8 and hence the first planetary gear 6 are carried by the rotary member 2 in a manner which will be described further on.

Secondly there is a second planetary gear 12 which is mounted on a shaft 14 carried by the rear part 2B of the rotary member; the planetary gear 12 meshes with internal gear teeth formed on an annular member 16 which comprises the "drive gear" according to this invention.

Thirdly there is an intermediate planetary gear 18 which is rotatably mounted on a bellcrank member 20 pivoted on the shaft 14; the planetary gear 18 meshes with the gears 6 and 12.

The annular member 16 or "drive gear" is driven at a predetermined speed as follows. It is secured to a gear 22 which is mounted on the shaft 4 via ball bearings 24 and meshes with a gear 26. This gear 26 is connected to a gear 28 and the two gears together are rotatably mounted on a stub shaft 30 carried by a fixed housing part 32. The gear 28 meshes with a gear 34 secured to the shaft 4; in other words, it provides the drive to the rotary member 2.

Figure 1A:
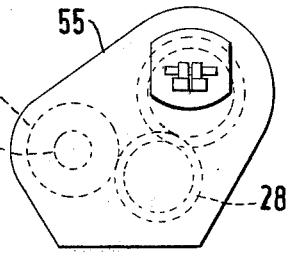
FIG. 1A is an outline side view of the whole ledger at a smaller scale.

The combined gear member 26, 28 may itself be driven in any desired manner, for example by means of a further gear 52 (see FIG. 1A).

The weight of the parts mounted eccentrically on the rotary member 2 is balanced by a counterweight 36 secured to the rotary member by screws 38 and 40 (FIG. 1) which pass through slots in flanges 36A on the counterweight 36, the slots being parallel to a radius of the rotary member 2 along which the first planetary gear 6 is adjustable. Thus the radial distance of the counterweight 36 can be adjusted to balance the rotary member.

During rotation of the rotary member 2, the first planetary gear 6 is maintained at a constant orientation as a result of the gears having the following number of teeth:

| Gear No. | No. of teeth |
|---|---|
| 6 | 45 |
| 12 | 37 |
| 16 | 120 |
| 18 | 37 |
| 22 | 64 |
| 26 | 40 |
| 38 | 52 |
| 34 | 52 |

The rod support 10 comprises two parts 10A and 10B which are spaced apart to leave a gap between them through which a rod-cutting knife (not shown) passes during each cut. The rod support is U-shaped so that it can move in a circular path and support the cigarette or other rod 42 while it is in the region of the top of its path. The two parts 10A and 10B of the rod support are secured to a flange 8A on the shaft 8 respectively by two screws 44 passing through slots in the parts 10A and 10B to allow the positions of these parts along the axis of the cigarette rod to be adjusted.

FIGS. 1 to 3 show the first planetary gear and rod support at an intermediate position in which the distance R between the axis 4A of the rotary member and the axis 6A of the planetary gear 6 is, for example, 16 mm. Thus the ledger with this setting is arranged to support the rod for cutting at intervals of 100.5 mm (i.e. $2 \times \pi \times 16$). The value of R can be reduced or increased in the following manner.

The shaft 8 carrying the planetary gear 6 and the rod support is mounted in a member 45 via ball bearings as shown in FIG. 2. The member 45 has a flange 45A which is secured to the front path 2A of the rotary member by four screws 46 passing through slots 48 in the flange 45A. It will be seen from FIG. 1 that, after loosening the screws 46, the member 45 can be moved radially inwards to reduce the value R. Alternatively, if a larger value of R is required, the screws 46 are removed, and the member 45 is inverted; the screws 46 are then replaced. Similarly, the screws 44 are removed and the rod support parts 10A and 10B are also inverted; the screws 44 are then replaced. This then allows the value R to be increased.

When R is adjusted, the position of the intermediate planetary gear 18 also requires adjustment to keep the gear 18 in mesh with the gear 6. This last adjustment is achieved by moving the bell crank 20 about its pivot axis on the stub shaft 14 after loosening a screw 50 (see FIG. 3) which passes through a slot 20A in the bell crank and secured the bell crank in position during use.

Adjustment of R also necessitates further adjustment in order to keep the top of the path of the rod support at the level of the rod 42. For this purpose, the height of the axis 4A of the rotary member needs to be adjusted. This is achieved as follows.

FIG. 1A is similar to FIG. 1 but shows the whole of the housing of the ledger and shows also a gear 52 which is mounted on a shaft 54 and meshes with the gear 28 to provide the drive for the ledger. The whole ledger housing 55, including the rotary member 2 and all the parts associated with it, is adjustable in position about the axis of the shaft 54. In other words, after loosening clamping bolts (not shown) the housing can be rotated slightly above the shaft 54 to raise or lower the rod support as necessary. Such pivotal movement changes slightly the orientation of the rod support. The orientation is restored as follows.

The gears 26 and 28 are formed as separate parts which are secured together by a number of screws 56 one of which is shown in FIG. 2. The screws 56 pass through arcuate slots in the gear 26 and engage in threaded holes in the gear 28, so that the gear 26 can be rotated slightly relative to the gear 28, after loosening the screws 56, to restore the rod support to its required orientation.

Figure 4:
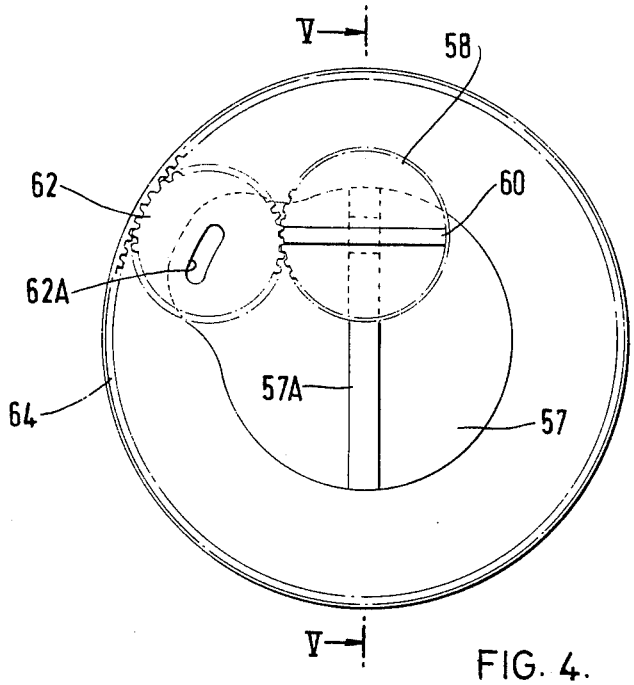
FIG. 4 is a diagrammatic side view of a modified ledger which is basically like that shown in FIGS. 1 to 3.
Figure 5:
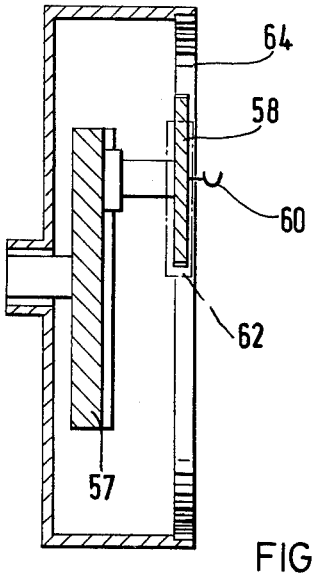
FIG. 5 is a section on the line V—V in FIG. 4.

FIGS. 4 and 5 show a ledger mechanism which is basically similar to that shown in FIGS. 1 to 3. A rotary member 57 carries a first planetary gear 58 which carries a rod support 60 and is maintained in a fixed orientation by a second planetary gear 62. The gear 62 is also carried by the rotary member 57 and meshes with the gear 58 and also with a surrounding gear 64. In other words, compared with the previous example, there is no intermediate planetary gear (i.e. the gear 18 in the previous example). As in the previous example, adjustment of the rod length (i.e. the intervals between cutting the continuous rod) is achieved by adjusting radially the position of the first planetary gear in this case gear 58. The planetary gear 62 is adjustable along the arcuate slot 62A curved about the axis of rotation 57A of the rotary member 57 so that it can be kept in mesh with the gear 58.

In order to maintain the planetary gear 58 and the rod support 60 in a fixed orientation, the gear 64 and rotary member 57 must be driven at speeds such that the following equation is satisfied:

$$\frac{\text{Speed of gear 58}}{\text{Speed of member 57}} = 1 + \frac{\text{Gear 58 diameter}}{\text{Gear 64 diameter}}$$

The same equation applies to the example shown in FIGS. 1 to 3; the diameter of the intermediate planetary gear 18 in that case is irrelevant.

Figure 6:
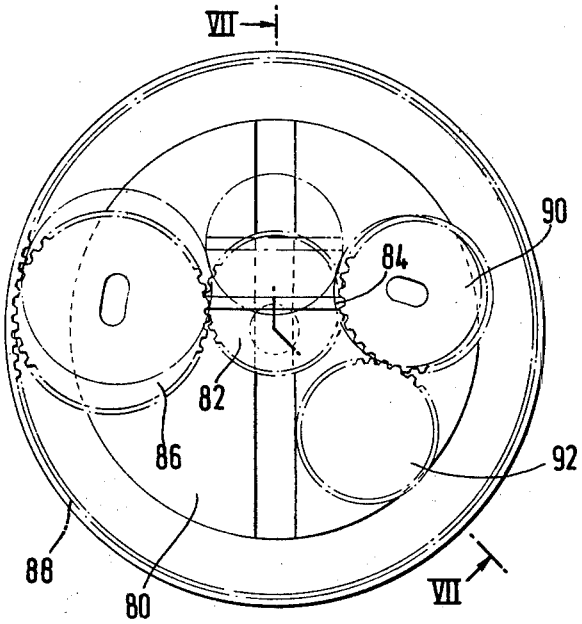
FIG. 6 is a diagrammatic side view of another ledger.
Figure 7:
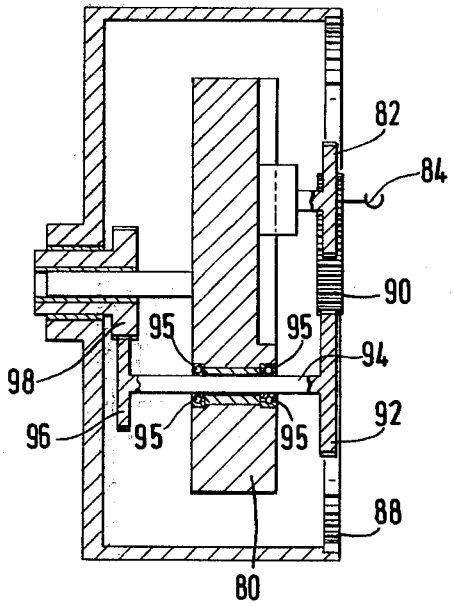
FIG. 7 is a section on the line VII—VII in FIG. 6.

In the example shown in FIGS. 6 and 7 a rotary member 80 carries a first planetary gear 82 which in turn carries a rod support 84. The rotary member 80 also carries a planetary gear 86, which meshes with the first planetary gear 82 and with an annular drive gear 88. The rotary member 80 also carries a third planetary gear 96 which meshes with a second drive gear 98. The third planetary gear 96 is mounted on a shaft 94 which is rotatably mounted by ball bearings 95 in the rotary member 80. The other end of the shaft 94 carries a further planetary gear 92 which is thus driven by the third planetary gear 96. The planetary gear 92 meshes with an intermediate planetary gear 90 which also meshes with the first planetary gear 82.

There are thus two inputs, namely to the second gear 98 and to the annular drive gear 88, the speeds of these inputs being such as to maintain the planetary gear 82 at a fixed orientation.

To allow for rod length adjustment, the gear 82 and rod support are adjustable radially relative to the rotary member 80, as in the previous examples; and in order to maintain the various gears in mesh as required, the gear 86 is adjustable in position about the axis of the rotary member 80, and the gear 90 is adjustable in position about the axis of the gear 92.

Figure 8:
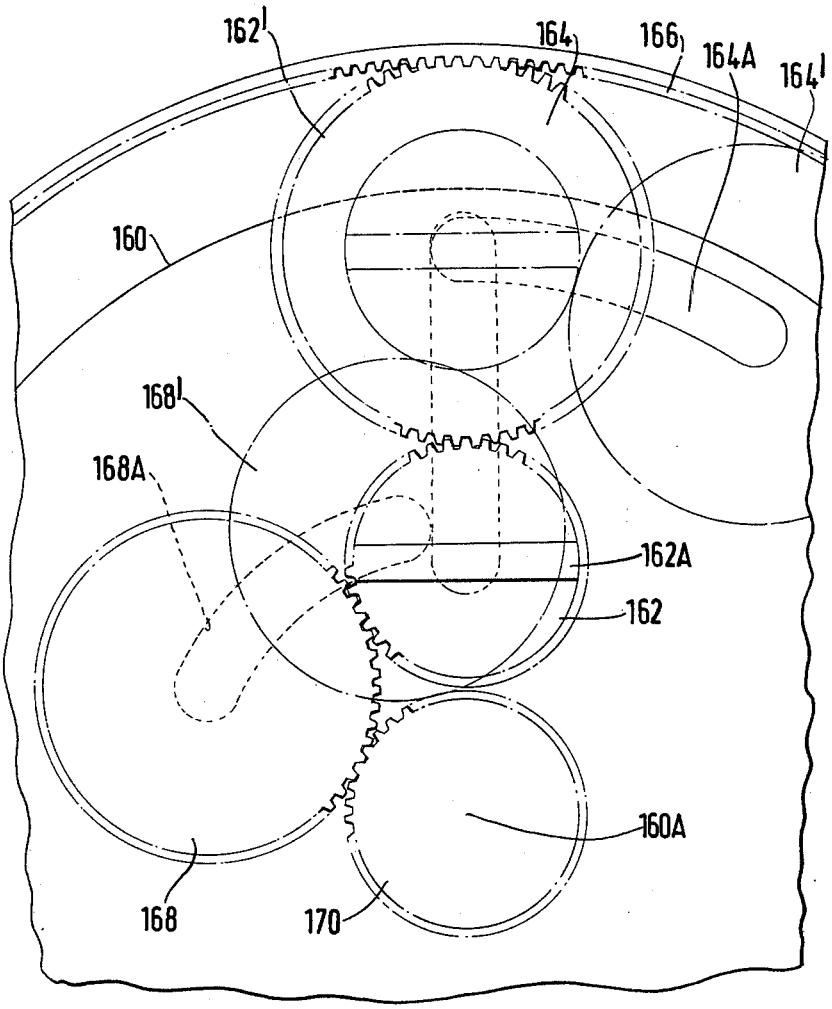
FIG. 8 is a diagrammatic side view of a fourth ledger.

The example shown in FIG. 8 has a rotary member 160 rotating about an axis 160A. A first planetary gear 162 is rotatably mounted on the rotary member 160 and meshes with a second planetary gear 164. The gear 162 carries the ledger, 162A. The gear 164 is also carried by the rotary member 160 and it meshes with an annular gear 166. The rotary member 160 also carries a third planetary gear 168 which meshes with the gear 162 and with a fixed gear 170 which is coaxial with the rotary member 160 and with the annular gear 166.

The gears 162 and 170 are of the same diameter.

This example has only one drive input, that is to the gear 166.

The length of cut is adjusted by varying the radial position of gear 162. When the radial position of the gear 162 is adjusted, both the gears 164 and 168 also need to be adjusted. Both of these gears are movable relative to the rotary member 160 along an arc centered on the axis 160A of the rotary member. The arcs are referenced respectively 164A and 168A in FIG. 8.

The maximum radial position for the gear 162 is shown chain dotted in FIG. 8, referenced 162'. When the gear 162 is in this position the gears 164 and 168 are in the positions 164' and 168' respectively. These also are shown chain dotted in FIG. 8.

The ledger shown in FIG. 8 may be modified to provide two or more circumferentially spaced rod supports providing a multiple-station ledger. For that purpose the rotary member 160 would carry two or more sets of gears and comprising the gears 162, 164 and 168.

I claim:

1. A ledger for use in a continuous rod cigarette making machine or a similar machine, comprising a rod support to support the continuous rod during cutting, a rotary member arranged to rotate about a fixed axis, a first planetary gear connected to the rod support and rotatable relative to the rotary member about an axis which is parallel to and spaced from the fixed axis, a second planetary gear mounted rotatably on the rotary member, the first planetary gear being maintained in a fixed orientation at least partly by the action of said second planetary gear, and a rotatably mounted drive gear arranged to rotate about the fixed axis at a speed different from that of the rotary member and to mesh with said second planetary gear.

2. A ledger according to claim 1 wherein the second planetary gear is arranged to also mesh with the first planetary gear.

3. A ledger according to claim 1 further comprising an intermediate planetary gear which is arranged to mesh with the first planetary gear and also with the second planetary gear.

4. A ledger according to claim 1 further comprising a second drive gear also arranged to rotate about the fixed axis and a third planetary gear carried by the rotary member and arranged to mesh with the second drive gear and also to assist in maintaining the first planetary gear in the fixed orientation.

5. A ledger according to claim 4 further comprising at least one intermediate planetary gear arranged to drivably connect the third planetary gear to the first planetary gear.

6. A ledger according to claim 1 further comprising a fixed gear mounted concentrically with the rotary member and a third planetary gear arranged to mesh with the first planetary gear and with said fixed gear.

7. A ledger according to claim 6 wherein the fixed gear and the first planetary gear are of the same diameter.

8. A ledger according to claim 6 further comprising a plurality of circumferentially spaced rod supports, each having a first planetary gear, a second planetary gear and a third planetary gear associated with it.

9. A ledger according to claim 1 further comprising means for adjusting the distance between said axis of the first said planetary gear and said fixed axis of the rotary member.

* * * * *